United States Patent [19]

Johnsson et al.

[11] 4,203,763

[45] May 20, 1980

[54] METHOD OF MANUFACTURING A LEAD ALLOY STEEL AND A STEEL MADE ACCORDING TO THE METHOD

[75] Inventors: M. K. Olof Johnsson, Degerfors; Karl-Erik Öberg, Viken; Harry Bertheussen, Degerfors, all of Sweden

[73] Assignee: Scandinavian Lancers Aktiebolag, Hoganas, Sweden

[21] Appl. No.: 962,936

[22] Filed: Nov. 22, 1978

[30] Foreign Application Priority Data

Dec. 21, 1977 [SE] Sweden ..... 7714561

[51] Int. Cl.[2] ..... C22C 33/08

[52] U.S. Cl. ..... 75/129; 75/130 R

[58] Field of Search ..... 75/53, 58, 129, 130 R, 75/49

[56] References Cited

U.S. PATENT DOCUMENTS

| | | | |
|---|---|---|---|
| 3,545,960 | 12/1970 | McClellan | 75/129 |
| 3,671,224 | 6/1972 | North | 75/49 |
| 3,728,109 | 4/1973 | Okubo | 75/129 |
| 3,756,805 | 9/1973 | Ormaechea | 75/129 |
| 3,836,359 | 9/1974 | Thomas | 75/129 |
| 3,955,966 | 5/1976 | Meichsner | 75/58 |
| 3,998,625 | 12/1976 | Koros | 75/58 |

*Primary Examiner*—P. D. Rosenberg

*Attorney, Agent, or Firm*—Murray and Whisenhunt

[57] ABSTRACT

Lead alloy steels, containing 0.15–0.35% of lead in the form of inclusions of average diameter less than 100 μm evenly distributed over a cross-sectional area, and without a tendency to macrosegregation of lead, are prepared by injecting into a steel melt lead containing particles of diameter less than 5 mm in an inert carrier gas which is injected at a rate sufficient to stir the melt and distribute the lead uniformly.

10 Claims, No Drawings

METHOD OF MANUFACTURING A LEAD ALLOY STEEL AND A STEEL MADE ACCORDING TO THE METHOD

DESCRIPTION

This invention relates to the manufacture of lead alloy steels.

When working lead alloy steels with cutting or chip removing tools, the tool wear may be considerably reduced by providing lead in the steel in the form of finely distributed metallic inclusions. The major problem when manufacturing lead alloy steels, however, is to produce the necessary small and evenly distributed lead inclusions and avoid macrosegregations of lead. Several methods for adding lead to steel melts have been suggested in the past, among which may be mentioned;

(a) adding lead in the form of granules or in the form of a wire to the stream of molten steel when casting the steel into an ingot mould, (b) adding metallic lead to the stream of molten steel when teeming the steel from one ladle to another, (c) adding metallic lead to a ladle at the same time as the molten steel in the ladle is stirred by blowing in argon gas through a porous bottom-brick.

However, in spite of the efforts involved in the development of the above mentioned methods, some macrosegregation of lead always occurs.

The present invention provides a method for manufacturing a lead steel alloy in which there are injected beneath the surface of a body of molten steel particles of lead and/or a lead compound having a diameter less than 5 mm, preferably less than 2 mm, by introducing the particles with a neutral carrier gas (a gas which does not take part chemically in the alloying process) until the content of lead in the molten steel amounts to 0.15–0.35% by weight, said neutral carrier gas being injected at a rate which brings about very efficient stirring of the melt so as to produce in the solidified steel small metallic lead inclusions evenly distributed over a section of the steel, said inclusions having average particle diameter less than 100 μm and without tendency to macrosegregations of lead.

In connection with the development of the invention, we have also found that it is possible to utilise the principles of the invention for manufacturing a steel having a crystal structure in the finished steel essentially corresponding to the crystal structure of so-called fine grain steels, without any addition of significant quantities of aluminium. This is surprising, as the favourable features of fine grain steels, i.e. a high yield strength and a low tenacity transition temperature, normally is achieved by means of nitrides in the region of the grain boundaries, usually Al-nitrides. The drawback with the Al-nitrides, as well as with Al-oxides which are unavoidable when adding aluminium to the steel, is that they wear strongly upon the tool material in cutting or chip removing operations. Therefore, the possibilities which the method of the invention may offer as regards manufacturing steels having properties similar to those of traditional fine grain steels, is of great practical importance. Thus in one embodiment of the invention, the particulate lead and/or lead compound is injected into a steel melt having such a low aluminium content that the content of aluminium in the finished steel will not exceed 0.010% by weight. This procedure, however, does not exclude the possibility of desoxidising the steel with aluminium prior to the injection, provided that not more than 2 kg aluminium per ton steel is used for the desoxidation and that a proper slag is provided on the surface of the melt, in which slag, the majority of the aluminium oxides may be collected.

Consequently, according to another aspect of the invention, a calcium compound, suitably lime, (CaO) may be supplied to the steel melt prior to and/or during the injection of lead to form a slag in which the majority of the aluminium in the melt may collect such that the aluminium content of the finished steel will not exceed 0.010% by weight. Niobium and vanadium have a similar effect to aluminium on the steel and each of niobium and vanadium preferably should not be present in the steel melt in quantities exceeding 0.010% by weight. The total of aluminium, niobium and vanadium in the finished steel should preferably not exceed 0.02% by weight.

It is also possible, according to the method of the invention, to manufacture free cutting lead-and sulphur-alloy steels. One way that this can be done is to use the lead mineral, lead sulphide (PbS), for simultaneously increasing the content of both lead and sulphur. Injecting lead sulphide below the surface of a desoxidised steel bath, gives a high yield of lead as well as of sulphur. The reaction $PbS \rightarrow Pb + S$ approaches an equilibrium at a lead content of about 0.18–0.22% by weight. In order to obtain as high a content of sulphur as of lead, the lead sulphide can be mixed with particulate elementary sulphur. Alternatively, or in addition to using PbS, it is possible to add sulphur in a conventional manner by introducing pieces of lump sulphur into the furnace containing the melt, or into a furnace used in a previous operation. Generally speaking, the total quantity of injected lead sulphide and of any additional sulphur should conveniently correspond to approximately 1.2 times the desired lead and sulphur content in the steel. The lead sulphide used is preferably dried and has a particle size less than 5 mm, sizes less than 2 mm being particularly preferred.

The method of the invention is conveniently carried out in a ladle and, for injection, a lance can be used which can be submerged into the melt in the ladle, preferably opening into the melt at a depth of at least one meter below its surface. For the preparation of the mixture of the neutral carrier gas and the lead-or lead compound powder, a powder disperser can be used in which a pressure up to 10 bar can be developed. The powder disperser can communicate with the injection lance via a flexible hose. The lance will normally be ceramically lined. The ladle will also normally be lined with chamotte (fire brick), although also other ceramic materials can be considered.

The invention will now be described more in detail with reference to the following Examples in which a chamotte lined ladle containing 40 tons of molten steel was used. Percentages given are by weight.

EXAMPLE 1

Lead sulphide, (PbS), was injected in the form of a powder having a particle size less than 1 mm, into a 40 tons steel melt having the following chemical composition: 0.26% C, 0.24% Si, 1.57% Mn, 0.014% P, 0.015% S, 0.018% Cr, 0.26% Mo, balance substantially all iron. The melt was well desoxidised with aluminium and was covered with a layer of a slag rich in lime and with a high basicity. 160 kg PbS were injected into the melt in a stream of argon over the course of about 9 minutes. The emitter-pressure (Pl) of the powder dispenser containing the PbS was 5 bar, while the ejector pressure was 4 bar. The gas flow in the lance was 1.2 $Nm^3$ argon per minute. The inner diameter of the lance was 19 mm, while the diameter in the region of the outlet was 10 mm.

When the injection was completed the steel was casted into ingots by bottom-pouring. Nine samples were taken from two different groups of ingots including samples from the top, from the middle, and from the bottom of the ingots, and also from different spots over cross sections of the ingots. Four of these samples had a lead content of 0.22% while five samples contained 0.21% lead. The sulphur content in the samples varied between 0.18 and 0.22%. The Example demonstrates that a very even distribution of lead is achieved in the steel. There were no observed tendencies to macrosegregations of lead. It appears that a very even feed of lead sulphide is important for good results, a difference of at least 1 bar between the emitter-pressure P1 of the powder dispenser and its ejector pressure P2 being of significant importance.

EXAMPLE 2

A steel was produced which, in casted condition, had the characteristics of a fine grain steel although it was essentially devoid of aluminium nitrides normally occurring in the grain boundaries of traditional fine grain steels. The starting material consisted of a steel melt which was well desoxidized with aluminium, although the aluminium introduced was less than 2 kg per ton steel. The steel melt weighed about 40 tons and had the following chemical composition: 0.35% C, 0.30% Si, 0.70% Mn, 0.09% P, 0.010% S, 0.15% Ni, 0.12% Cr, balance essentially iron. 170 kg lead sulphide was injected with argon as a carrier gas through the same lance and in the same ladle as described in Example 1 over about 8 minutes, the carrier gas consumption being about 9 $Nm^3$ argon. The melt was covered by a lime rich slag of high basicity. The lance was submerged to a depth of about 1.5 m below the surface of the melt. The temperature of the melt prior to injection was 1640° C. and after injection about 1590° C. After the injection, the chemical composition of the steel was the following: 0.35% C, 0.30% Si, 0.82% Mn, 0.013% P, 0.026% S, 0.14% Cr, 0.15% Ni, 0.20% Pb, 0.008% Al, balance essentially iron. As in Example 1 the samples of the cast steel had a crystal structure of the kind typically found in aluminium alloyed fine grain steels.

EXAMPLE 3

Metallic lead was injected into an unalloyed steel melt by the general procedure described in Example 1. The lead had the form of particles varying in shape from powder to small shot having diameters up to about 1 mm. In this Example the emitter pressure of the powder dispenser was 4 bar and the ejection pressure 3 bar. As in Example 1, the samples of the cast steel had a crystal structure of the kind typically found in aluminium alloyed fine grain steel.

We claim:

1. A method of manufacturing a lead alloy steel, wherein lead bearing particles are injected beneath the surface of a body of molten steel, said particles having a diameter less than 5 mm, said injection being carried out by introducing the particles with a neutral gas until the content of lead in the molten steel is 0.15 to 0.35% by weight, said neutral carrier gas being injected at a rate which brings about very efficient stirring of the melt so as to produce, in the solidified steel, small metallic lead inclusions evenly distributed over a section of the steel, said inclusions having average particle diameters less than 100 μm, and without tendency to macrosegregations of lead, and wherein prior to the injection of said lead bearing particles, the molten steel is deoxidized by treatment with up to 2 kg aluminum per ton steel, and a calcium compound is added to the molten steel during a stage which is not later than the lead injection to form a slag, the major portion of the entire content of aluminum being collected in the slag so that the aluminum content in the finished steel does not exceed 0.010% by weight.

2. A method according to claim 1 wherein the particle diameter is less than 2 mm.

3. A method according to claim 1 wherein at least part of the lead is supplied in the form of lead sulphide to give a finished steel containing 0.10 to 1.0% by weight sulphur.

4. A method according to any one of claims 1 through 3 wherein elementary sulphur is introduced into the melt to give a finished steel containing 0.10 to 1.0% by weight sulphur.

5. A method according to any one of claims 1 through 3 wherein the molten steel contains not more than 0.010% by weight of each of niobium and vanadium.

6. A method according to claim 5 wherein the total content of aluminum, niobium and vanadium in the finished steel is not more than 0.02% by weight.

7. A method according to any one of claims 1 through 3 wherein the particles are injected into the melt through a lance which opens into the melt at a depth of at least one meter below its surface.

8. A method of manufacturing a lead alloy steel, wherein lead bearing particles are injected beneath the surface of a body of molten steel, said method comprising deoxidizing the molten steel prior to injection of said lead bearing particles by treatment with up to 2 kg aluminum per ton steel, and adding a slag-forming calcium compound to the molten steel during a stage which is not later than the lead injection to form a slag, the major portion of the entire content of aluminum being collected in the slag so that the aluminum content in the finished steel does not exceed 0.010% by weight, and injecting lead particles having a diameter less than 5 mm into said molten steel by introducing the particles with a neutral carrier gas beneath the surface of the molten steel until the content of lead in the molten steel is 0.15 to 0.35% by weight, said neutral carrier gas being injected at a rate which brings about very efficient stirring of the melt so as to produce, in the solidified steel, small metallic lead inclusions evenly distributed over a section of the steel, said inclusions having average particle diameters less than 100 μm, and without tendency to macrosegregations of lead.

9. A lead alloy steel obtained by a method according to any one of claims 1 through 3 or 8.

10. A method of manufacturing a lead alloy steel, said method comprising forming in the solidified steel small metallic lead inclusions having an average particle diameter of less than 100 μm, without tendency to macrosegregations of lead, and substantially evenly distributed over a section of the steel by injecting lead bearing particles having a diameter less than 5 mm beneath the surface of a body of molten steel until the content of lead in the molten steel is 0.15 to 0.35% by weight, said lead bearing particles being introduced beneath the surface of said molten steel with a neutral carrier gas, and stirring said melt during said injection by injecting said gas at an efficient stirring rate.

* * * * *